United States Patent [19]

Banker

[11] Patent Number: 4,493,737

[45] Date of Patent: Jan. 15, 1985

[54] METHOD FOR FABRICATING URANIUM ALLOY ARTICLES WITHOUT SHAPE MEMORY EFFECTS

[75] Inventor: John G. Banker, Boulder, Colo.

[73] Assignee: The United States of America as represented by the United States Department of Energy, Washington, D.C.

[21] Appl. No.: 151,849

[22] Filed: May 21, 1980

[51] Int. Cl.[3] ..... C22F 1/18

[52] U.S. Cl. ..... 148/11.5 R; 148/131

[58] Field of Search ..... 148/11.5 R, 11.5 F, 148/131

[56] References Cited

U.S. PATENT DOCUMENTS

| | | | |
|---|---|---|---|
| 2,830,921 | 4/1958 | Creutz | 148/11.5 R |
| 2,914,433 | 11/1959 | McGeary et al. | 148/11.5 R |
| 3,567,523 | 3/1971 | Jackson et al. | 148/11.5 R |
| 3,595,060 | 7/1971 | Hundy | 72/364 |
| 3,802,930 | 4/1974 | Brook et al. | 148/11.5 R |
| 3,864,176 | 2/1975 | Swanson | 148/11.5 R |
| 3,953,253 | 4/1976 | Clark | 148/131 |
| 3,954,515 | 5/1976 | Swanson | 148/11.5 R |
| 4,126,492 | 11/1978 | Okunishi et al. | 148/131 |

FOREIGN PATENT DOCUMENTS

| | | |
|---|---|---|
| 682053 | 3/1964 | Canada . |
| 806971 | 1/1959 | United Kingdom . |

OTHER PUBLICATIONS

Vandermeer et al., "Shape Memory in a Uranium +14 at. % Niobium Alloy," Metallurgica, vol. 12, 1978, pp. 243–248.

*Primary Examiner*—Peter K. Skiff

*Attorney, Agent, or Firm*—Earl L. Larcher; Stephen D. Hamel

[57] ABSTRACT

Uranium-rich niobium and niobium-zirconium alloys possess a characteristic known as shape memory effect wherein shaped articles of these alloys recover their original shape when heated. The present invention circumvents this memory behavior by forming the alloys into the desired configuration at elevated temperatures with "cold" matched dies and maintaining the shaped articles between the dies until the articles cool to ambient temperature.

3 Claims, No Drawings

METHOD FOR FABRICATING URANIUM ALLOY ARTICLES WITHOUT SHAPE MEMORY EFFECTS

This invention was made as a result of a contract with the U.S. Department of Energy.

BACKGROUND OF THE INVENTION

The present invention relates generally to the fabrication of uranium-alloy articles into desired configurations, and more particularly to fabricating articles of uranium alloys exhibiting shape memory effects wherein the method of the present invention circumvents the memory behavior of the alloys.

Uranium is often alloyed with various metals to improve the resistance of the uranium to corrosion. Alloys of uranium containing niobium (5–23 wt.%) and zirconium (0–10 wt.%) afford satisfactory corrosion resistance. To obtain the desired corrosion resistance, these alloys are usually heated to a temperature greater than the gamma phase formation temperature (about 647° C.) and then rapidly quenched to ambient temperature to transform the gamma phase by a martensitic process to a transition phase which is a monoclinic distortion of the orthorhombic alpha-uranium structure that is metastable at ambient temperature. It was previously discovered that such uranium alloys when stressed or deformed while in this martensitic state to a selected configuration recover their preformed shape when heated to temperatures greater than about 100° C. This shape recovery of the uranium alloys is known in the art as shape memory effect. It was found that up to a certain deformation strain about 100% of the original shape was recoverable by the heating of the formed articles. This pseudo-plastic behavior of the uranium-niobium alloys is described in U.S. Pat. Nos. 3,567,523 and 3,802,930 dated Mar. 2, 1971 and Apr. 9, 1974, respectively. These patents relate to processes in which the pseudo-plastic behavior of uranium-niobium alloy is utilized in selected configurations to demonstrate complete reversability of the deformed configuration at both below and above the deformation temperature. Further discussion of this shape memory effect of uranium alloys is set forth in the publication *Metallurgica,* Vol. 12, pp. 243–248 (1978), printed by Pergamon Press, Inc., and entitled "Shape Memory Effects in a Uranium+14 at .% Niobium Alloy," by R. A. Vandermeer et al. In the aforementioned patents and publication the shape memory effects of uranium-niobium alloys are described in detail and stress important advantages achieved by utilizing such memory effects in area such as bimetallic strips and other heat-controlled configurations.

However, while the shape memory effects of these uranium alloys are often desirable, there are many instances where the memory effect of the alloys is not desirable and in fact is detrimental to the intended use of the alloy. For example, the shape memory effects would be undesirable in structural applications of the alloy.

In applications where the memory effect is not desirable it is common practice to form parts above the 647° C. transformation and then to water quench to the metastable phase. The distortion resulting from the quench and the roughened, hot-worked surfaces are generally eliminated by subsequent machining. However, for thin gage, non-symmetrical components this manufacturing sequence is generally uneconomical and in many cases practically impossible. Thin-gage, non-symmetrical parts are generally formed by established sheet metal working techniques at ambient temperatures. However, for the said uranium-niobium and uranium-niobium-zirconium alloys these established sheet forming techniques yield components which are extremely dimensionally unstable during thermal cycling. For example, if a uranium-6 wt.% niobium flat plate is formed into a configuration with 5 to 10% plastic strain by established sheet working techniques at 23° C., and the part is subsequently heated to 150° C., the part will revert to its orignial flat shape during the thermal cycle.

To obtain the desired dimensional stability and corrosion resistance, the part must be quenched from a temperature at which it is in the gamma phase after it is fully formed to the desired shape. When a cold formed part is heat treated it loses its formed shape due to shape memory in the upward heating cycle.

The problem cannot be solved by intermediate temperature forming due to the transformation to phases with undesirable corrosion resistance (alpha uranium) at temperatures between the gamma transformation temperature and the shape change temperature.

SUMMARY OF THE INVENTION

Accordingly, it is the primary objective or aim of the present invention to provide a method wherein uranium-niobium and uranium-niobium-zirconium alloys may be fabricated into stable configured articles which do not require subsequent machining while circumventing the shape memory effects of the alloys. The subject method which prevents this pseudo-plastic behavior from occurring comprises the steps of heating the alloy in an inert atmosphere to a temperature above the gamma transformation. The heated alloy is then very quickly formed between matched dies of the desired configuration which are at a temperature below the martensitic transformation temperature of the alloy. The deformation of the alloy by the dies is performed while the metal is in the gamma phase and is fully completed prior to cooling of the alloy to a temperature at which the alloy is subjected to a martensitic phase transformation. The configured alloy is maintained in the deformed configuration within the dies until the alloy cools to ambient temperature. The sequence of the present invention accomplishes the goals of (1) forming at an elevated temperature to avoid the shape memory effect (2) quenching from the gamma phase to avoid formation of the less-corrosion resistant micro-structural phases, and (3) quenching the part in the forming dies to maintain the desired shape.

Other and further objects of the invntion will be obvious upon an understanding of the illustrative method about to be described or will be inidicated in the appended claims, and various advantages not referred to herein will occur to one skilled in the art upon employment of the invention in practice.

The method of the present invention is utilized primarily for the fabrication of the aforementioned uranium aloys while in the form of sheet material of a thickness in the range of about 0.010 to 0.200 inch. The sheet material is quickly (about 1 to 10 minutes) heated to a temperature at least sufficient to effect plastic deformation of the alloy. Preferably, this temperaure is in the range of about 750° to 850° C. which is greater than that below which the gamma phase of uranium is not stable as pointed out above. The heating of the uranium alloys is effected in an inert atmosphere such as argon or the like in a preheated resistance furnace or an induction furnace. After heating the sheet of uranium alloy to the desired temperature it is placed in matched dies formed of tool steel or the like which are at a temperature in the range of about 0° to 25° C. These relatively cold dies are closed very quickly (1 to 2 seconds) to form the heated sheet of uranium alloy into the desired article configuration before the uranium alloy is quenched by the dies to a temperature below the aforesaid martensitic transformation temperature. If the dies are not closed sufficiently fast to form the sheet before it cools to a temperature at which gamma-to-alpha transformation begins, the corrosion resistance of the product will be significantly reduced. After forming the article into the desired shape it is maintained in the matched dies until the uranium alloy cools to ambient temperature. The resulting configured article possesses a stable microstructure having mechanical and chemical properties characteristic of the rapid quenched material but does not possess the shape memory effects of such uranium-rich alloys as heretofore encountered. The dies utilized for the deformation of the uranium alloy sheet material are maintained in the above temperature range of 0° to 25° C. during the entire deformation and cooling cycles so as to assure a uniform and yet fairly rapid cooling of the sheet material. The maintaining of the dies in this temperature range may be readily achieved by running a suitable coolant through passageways in the die body.

In order to provide a more facile understanding of the present invention, an example relating to the present invention is set forth below wherein some strips of uranium-6 wt.% niobium alloy were treated by the method of the present invention while a second set were formed and rapidly quenched as previously practiced, and a third set were formed at ambient temperature.

EXAMPLE

Six strips of uranium-6 wt.% niobium alloy were prepared from a sheet of the alloy having a thickness of about 0.1 inch with the strips having a width of about 1 inch and a length of about 6 inches. Four of the strips were rapidly heated to 800° C. in an argon atmosphere and then placed between cold matched dies maintained at ambient temperature. The strips were formed into an arch shaped configuration with the matched dies utilizing a pressure of about 300 psi which was applied to the hot strips for a period of about 2 seconds. The temperature of the strips during the forming operation was in the range of about 700°-800° C. which is above the gamma phase transformation temperature. Two of the four strips were held between the cold dies until they cooled to room temperature. The other two strips were removed from the die and rapidly quenched in water immediately after they were formed into the desired arch. The water-quenched strips and the die-quenched strips possessed similar microstructures as well as similar mechanical properties and corrosion resistance. However, the die-quenched parts maintained the desired shape while the water-quenched parts were very distorted and did not conform to the desired die contour.

The third set of strips was heated to 800° C. as before and water quenched to obtain the same microstructure, mechanical properties, and corrosion resistance. These parts were then formed in the same dies at room temperature to obtain the desired shape.

The three sets of parts were then thermal cycled between 0° and 200° C. The four formed-and-quenched parts were dimensionally stable while the two quenched-and-formed parts consistently transformed to their original flat plate shape during the thermal cycle.

It will be seen that the present invention provides a mechanism by which the favorable properties of uranium-niobium alloys may be utilized in the fabrication of thin-wall shaped articles without encountering the shape memory effects when subjecting the shaped alloy articles to elevated temperatures.

What is claimed is:

1. A method for fabricating a configured article of uranium alloy consisting essentially of uranium, 5 to 23 wt.% niobium, and 0 to 10 wt.% zirconium by plastic deformation so as to obviate the shape memory effects characteristic of the alloy when the configured article is subsequently heated to a temperature greater than about 100° C., said method comprising the steps of heating the alloy in an inert atmosphere to a temperature above the gamma transformation temperature of the alloy, quickly forming the heating alloy into a desired article configuration with matched dies each maintained at a temperature substantially below the martensitic transformation temperature of the alloy, completing the formation of the alloy into said configuration prior to cooling of the alloy to a temperature below which the alloy is subjected to an alpha phase transformation, cooling said alloy, and maintaining the alloy in said configuration with said dies until said alloy cools to ambient temperature.

2. The method claimed in claim 1, wherein the uranium alloy article is formed from a sheet of the alloy having a thickness in the range of 0.010 to 0.200 inch.

3. The method claimed in claim 1, wherein the temperatures of the matched dies are maintained at a temperature in the range of 0° to 25° C. during the forming step and the step of cooling of the configured article to ambient temperature.

* * * * *